United States Patent [19]

Pantzar

[11] 4,393,590

[45] Jul. 19, 1983

[54] SAW GUIDE BAR

[75] Inventor: Glenn G. E. Pantzar, Arsunda, Sweden

[73] Assignee: Santrade Ltd., Lucerne, Switzerland

[21] Appl. No.: 303,041

[22] Filed: Sep. 17, 1981

[30] Foreign Application Priority Data

Oct. 3, 1980 [SE] Sweden ..... 8006930

[51] Int. Cl.[3] ..... B27B 17/02

[52] U.S. Cl. ..... 30/387

[58] Field of Search ..... 29/509; 30/387, 386, 30/383; 76/112; 83/835

[56] References Cited

U.S. PATENT DOCUMENTS

| | | | |
|---|---|---|---|
| 3,191,646 | 6/1965 | Merz | 30/387 |
| 3,416,578 | 12/1968 | Irgens | 30/387 |
| 3,473,581 | 10/1969 | Merz | 30/387 |
| 3,496,973 | 2/1970 | Ballard | 83/835 |
| 3,990,338 | 11/1976 | Wikner | 76/112 X |

*Primary Examiner*—Jimmy C. Peters

*Attorney, Agent, or Firm*—Burns, Doane, Swecker & Mathis

[57] ABSTRACT

This invention relates to a saw guide bar comprising two side plates and an intermediate layer. Each side plate comprises a layer of reinforced plastic material and a layer of metal.

12 Claims, 4 Drawing Figures

A A

B B

C C

SAW GUIDE BAR

This invention relates to a saw guide bar having a very low weight.

Since the motor saw was introduced on the market the motor saw manufacturers have had an ambition to make the saws lighter and lighter. Lately the weight of the saw itself has been reduced, while the saw guide bar has not been changed much in order to reduce its weight.

This invention relates to the saw guide bar itself and brings about a solution of the problem how to reduce the weight of the saw guide bar substantially.

Figure 1:
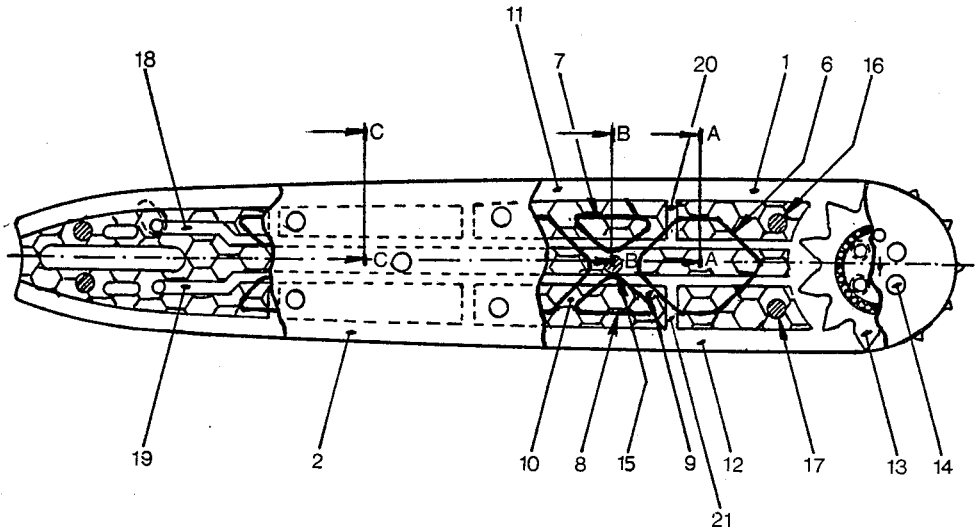
Figure 2:
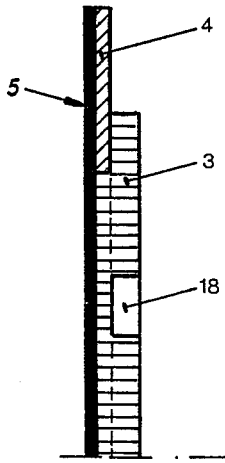
Figure 3:
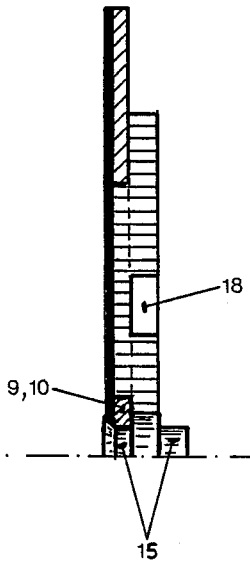
Figure 4:
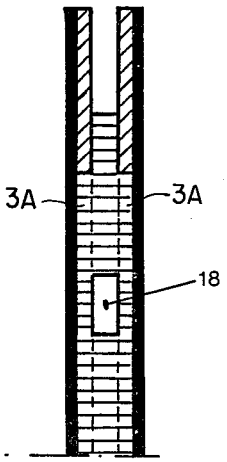

A preferred embodiment of the invention shall be described more closely in connection with the accompanying drawing in which FIG. 1 is a side view of a saw guide bar, which is partly cut out, FIG. 2 is a section along the line A—A of FIG. 1, FIG. 3 is a section along the line B—B of FIG. 1, and FIG. 4 is a section along the line C—C of FIG. 1, which section is taken at a lightening hole similar to that present at the line A—A.

The saw guide bar is built up by two side plates 1, 2 and an intermediate layer 3, each side plate 1, 2 comprising two layers 4, 5. The outer one 5 of these two layers comprises reinforced plastic material, the reinforcement preferably comprising fibers of high coefficient of elasticity, for instance carbon-, boron-, metal-, glass- or aramide fibers. Inside the outer layer there is a wear-resistant metal layer 4 forming the sliding surfaces for the side links and the projections of the driving links of the saw chain. The wear-resistant layer 4 also forming the guide surface for a toothed idler sprocket and bringing about high bending resistance of the unit is fastened to the outer layer for instance by means of glueing. In order to reduce the weight further substantial recesses in the form of lightening holes 6, 7, 8 have been made in each metal layer. In this connection bridges 9, 10 in selected places have been left in order to keep the bending resistance in the metal layer, which bridges connect the upper 11 and the lower 12 longitudinal parts of the metal layer with one another. It ought to be observed that in the drawing behind the side plate 2 partly cut away there are further lightening holes similar to those disclosed.

In order to reduce the weight of the saw guide bar further the intermediate layer 3 is manufactured of a cell structure preferably made of metal, the cells being directed substantially perpendicular to the longitudinal direction of the saw guide bar. Further, the cells preferably are made hexagonal and have a form similar to that of a honey comb. Due to the described construction the intermediate layer has a very high compression resistance, whereby the two side plates of the saw guide bar can be powerfully forced against the intermediate layer in order to form a stable unit, i.e. a saw guide bar having a stable construction, without deformation of the intermediate layer. The intermediate layer is fastened to the two side plates preferably by glueing. Portions 3A of the intermediate layer protrude into the holes in the inner layers 4 and abut the outer layers 5, as depicted in FIGS. 2-4.

The extension of the intermediate layer 3 in the longitudinal direction of the saw guide bar is adapted such that a toothed idler sprocket 13, journalled between the two side plates 1, 2 of the saw guide bar preferably by rivets 14, can freely rotate, the wear-resistant metal layer 4 forming a guide surface for the side surfaces of the toothed idler sprocket 13. Further, the extension of the intermediate layer 3 in the transverse direction of the saw guide bar is adapted such that a track for the saw chain is formed at the edges of the saw guide bar, whereby the saw chain can unimpededly slide round the saw guide bar.

In order to prevent the risk that the side plates 1, 2 shall be teared off from the intermediate layer 3 one or several rivets may be arranged on suitable places of the guide bar, which rivets are suitably provided with a collar on their shafts so that the intermediate layer is not overloaded. Such rivets, which are indicated by the numerals 15, 16, 17, contribute to improve the strength of the unit and also to keep the width of the chain track intact at the edges of the saw guide bar.

In the intermediate layer are formed at least one and preferably two lubrication channels 18, 19 extending along the guide bar in which channels oil shall be brought from the saw motor to the idler sprocket of the saw guide bar.

Other channels 20, 21 may extend in the intermediate layer 3 from the central, longitudinal channels 18, 19 out to the chain track at the edges of the guide bar in order to secure good lubrication also of the chain.

The invention is not limited to the described embodiment. Thus, the invention idea can also be applied to guide bars without idler sprocket. Further, the form of the cells has been disclosed as to be hexagonal such that the structure of the cells is similar to that of a honey comb. Although this form of the cells is to prefer, the cells, however, may have another form, for instance square section.

In FIG. 1 of the drawing for the sake of clearness the lightening holes have been marked with continuous lines in spite of the fact that with regard to the position behind the intermediate layer they ought to have been marked with lines of short dashes.

I claim:

1. A chain saw guide bar comprising two side plates and an intermediate layer, each of said side plates comprising an outer layer of fiber-reinforced plastic material and an inner layer of metal which is glued to said outer layer, said intermediate layer being of less height than said inner layers such that said inner layers and said intermediate layers form a guide track for a saw chain.

2. A guide bar according to claim 1, wherein the reinforcement fibers for said outer layer comprise carbon, boron, metal, glass or aramide fibers.

3. A guide bar according to claim 1, wherein said intermediate layer comprises a cell structure of metal.

4. A guide bar according to claim 3, wherein the cells are of hexagonal section and are arranged in honeycomb relationship.

5. A guide bar according to claim 4, wherein said inner layers each include weight-reducing holes, portions of said intermediate layer protrude into said holes and abut said outer layers.

6. A guide bar according to claim 1, wherein said intermediate layer includes at least one longitudinal channel for conducting lubrication oil.

7. A guide bar according to claim 6 including at least one lateral channel extending laterally from said longitudinal channel and communicating the latter with said guide track.

8. A guide bar according to claim 1, wherein said intermediate layer is fastened by gluing to said side plates and by at least one rivet.

9. A guide bar according to claim 1, wherein said inner layers each include weight reducing holes.

10. A guide bar according to claim 9, wherein the weight reducing holes are spaced apart to create bridge portions of said inner layer which interconnect upper and lower portions of said inner layer.

11. A guide bar according to claim 1 including a toothed idler sprocket rotatably mounted between said inner layers such that the latter form guide surfaces therefor.

12. A guide bar according to claim 1, wherein said inner layer is formed of steel.

* * * * *